US008333878B2

(12) United States Patent
Seradarian et al.

(10) Patent No.: US 8,333,878 B2
(45) Date of Patent: Dec. 18, 2012

(54) WEAR RESISTANT WHEEL COATING AND METHOD

(75) Inventors: Pascal Seradarian, Princeton Junction, NJ (US); Larry K. Rogers, Bordentown, NJ (US); Dawn M. DiMarco, Newtown, PA (US); Robert D. Holmers, Albany, NH (US)

(73) Assignee: Hutchinson, SA, Paris (FR)

( * ) Notice: Subject to any disclaimer, the term of this patent is extended or adjusted under 35 U.S.C. 154(b) by 335 days.

(21) Appl. No.: 12/799,763

(22) Filed: Apr. 30, 2010

(65) Prior Publication Data

US 2011/0266157 A1 Nov. 3, 2011

(51) Int. Cl.
*C25D 13/06* (2006.01)
*C23C 28/04* (2006.01)
*C23F 17/00* (2006.01)

(52) U.S. Cl. ..... 204/488; 204/471; 204/483; 204/484; 204/486; 204/487; 204/499; 204/500; 204/501; 204/502

(58) Field of Classification Search ..... 204/471, 204/483, 484, 486, 487, 488, 499, 500, 501, 204/502

See application file for complete search history.

(56) References Cited

U.S. PATENT DOCUMENTS 5,242,716 A * 9/1993 Iwase et al. ..... 427/407.1

* cited by examiner

*Primary Examiner* — Bruce Bell
(74) *Attorney, Agent, or Firm* — Steven R. Scott

(57) ABSTRACT

This invention teaches a method of coating a vehicle wheel to increase wear resistance which, in its preferred embodiment, includes the steps of providing a vehicle wheel and applying a wear resistant coating between/intermediate a primer and a topcoat. The wear resistant coating is applied to at least the tire bead flange of the vehicle wheel but may be applied to any area of the wheel. It is advantageously comprised of a MIL-P-53022B Type II lead and chromate free, corrosion inhibiting epoxy primer with an addition of 3% polytetrafluoroethylene (PTFE), and is formulated in such a manner so as to allow "wet on wet" application over a cured MIL-P-53084 primer. This application method improves adhesion through surface to surface covalent reaction between the polymerization of polyurethane top coat and the polymerization of intermediate epoxy polyamide wear resistant coating. The wear resistant coating is of particular use with vehicle wheels made from cast or forged aluminum, but may also be used by itself over steel wheels that have been pretreated to TT-C-490. It may also be used over anodized, electrocoated, or DOD-P-15328 wash primed aluminum as a standalone non CARC wear resistant coating.

20 Claims, 3 Drawing Sheets

WEAR RESISTANT WHEEL COATING AND METHOD

BACKGROUND AND SUMMARY

The present invention relates generally to vehicle wheels. More particularly, it is concerned with wheels for trucks and other utility vehicles and wear resistant coatings and methods for applying said coatings.

Vehicle wheels can experience a degree of wear deleterious to their immediate and long-term function due to their extended and rigorous use during and through the operation of motor vehicles. One mechanism by which said wear occurs is the extended frictional contact between the tire mounted on the wheel and the wheel itself. This occurs due to sliding between the tire and wheel, creating consequent abrasion, adhesion, and other wear issues. This problem is particularly acute when dealing with large trucks and other utility vehicles. It is further exacerbated where wheels are used on and with military vehicles, where the degree of wear and tear experienced due to operation for extended periods in harsh conditions can lead to premature wheel wear and/or failure.

Possible solutions for the aforesaid problem include the use of stronger more durable materials in forming wheels, and providing wear resistant coatings between wheels and tires. Providing wheels formed from steel is one obvious approach to the problem of creating more durable wheels. However, though steel wheels are inherently more wear resistant, they have been largely replaced by aluminum wheels due to the lighter weight of the latter. (Steel has 2.8 times the density of aluminum). Anodizing can be used to make aluminum itself more wear resistant. Unfortunately, some types of anodizing can reduce fatigue strength of the metal by up to 50%. Application of wear resistant metallic or ceramic coating has also been tried. (See, e.g., U.S. Pat. No. 6,872,425). However, prior art coating materials/methods, such as those described in the '425 patent, are expensive, complex, and may include or require pre-coating preparation such as mechanical roughening, knurling and/or abrasive grit blasting. Thus, a definite need exists for further advances in the field of wear resistant wheel coatings and methods capable of protecting vehicle wheels from wear and corrosion, particularly from such wear and corrosion as arises from wheel/tire frictional contact, and even more particularly from such wear and corrosion in truck, utility and military vehicle wheels formed from aluminum.

This need is met in a novel and non-obvious way by the method and coating of the invention, which in its most basic embodiments, involves the addition of a slip agent to an appropriate wheel coating. In its more preferred embodiments, the slip agent is one that will not adversely impact intercoat adhesion in a multi-coat wheel coating system. And, in its most preferred embodiment, as discussed in detail herein, the slip agent is included in an intermediate coating applied between a wheel's primer and topcoat. More particularly, the intermediate coating is comprised of a MIL-P-53022 Type I or Type II lead and chromate free, corrosion inhibiting epoxy primer with an addition of 3% polytetrafluoroethylene (PTFE), and is preferably applied to the wheel intermediate the primer and topcoat in accordance with the chemical agent resistant coating (CARC) system used on tactical military equipment.

DESCRIPTION

Figure 1:
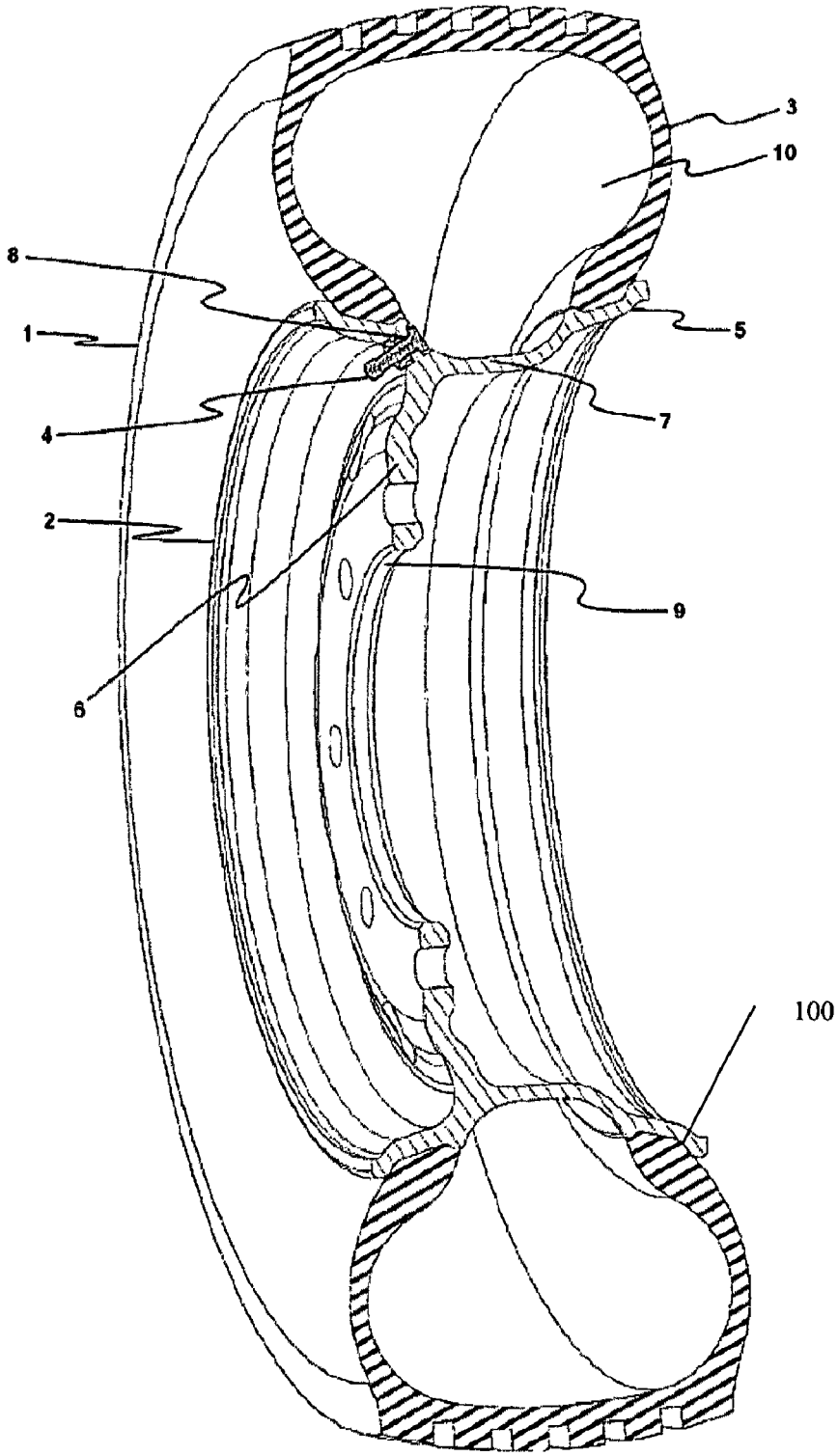
FIG. 1 provides a schematic perspective and partial cross-sectional view illustrating a typical one piece wheel assembly with tire in accordance with the teachings of prior art.
Figure 2:
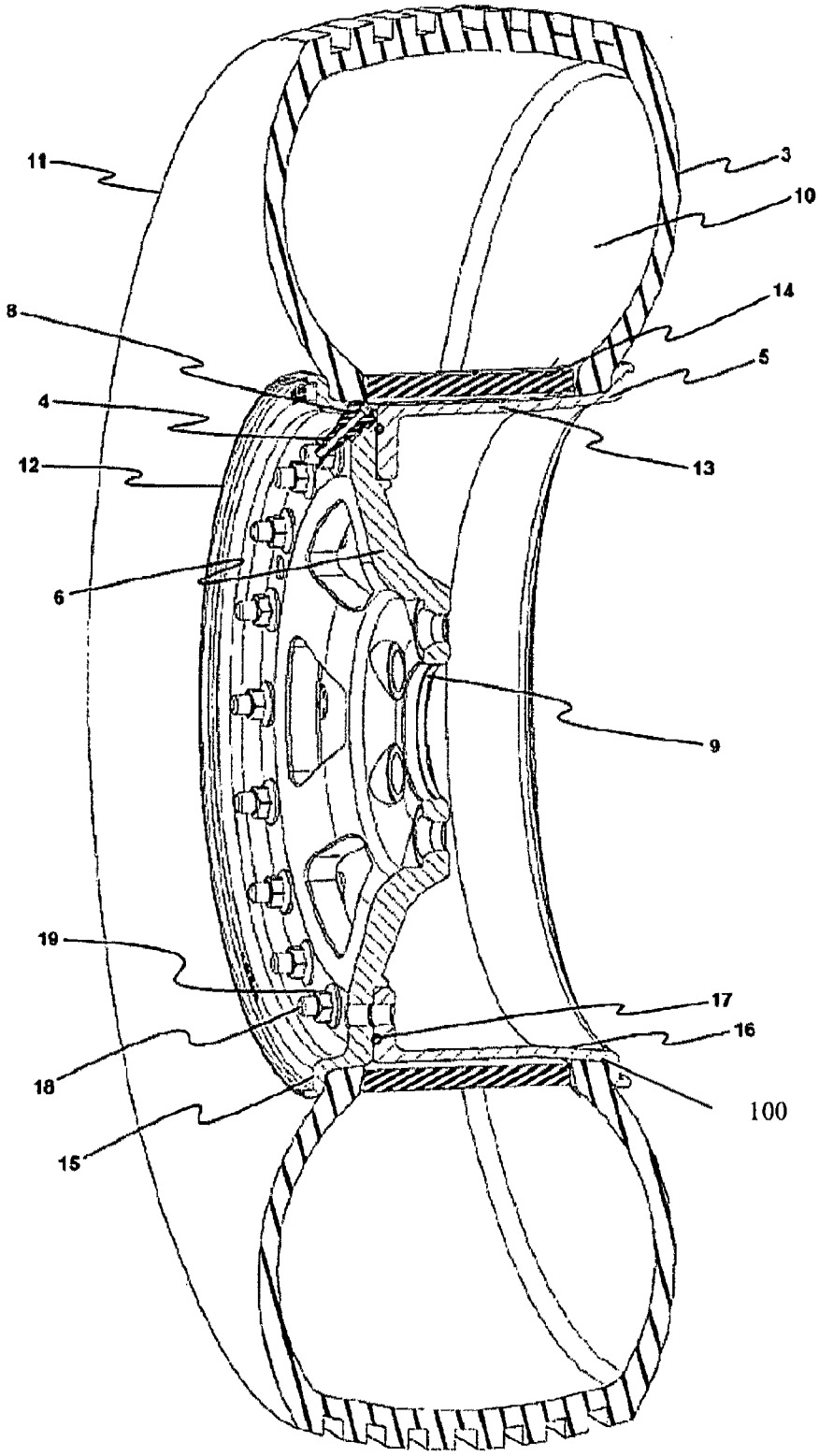
FIG. 2 provides a schematic perspective and partial cross-sectional view illustrating a typical two piece wheel assembly with tire in accordance with the teachings of prior art.

FIGS. 1 and 2 provide typical examples of prior art wheel assemblies capable of use with and for the purposes of the instant invention. FIG. 1 shows a section of a one-piece wheel assembly 1. The one-piece wheel assembly 1 consists of a wheel 2 with tire 3 and inflation valve 4. The circular wheel 2 includes a rim portion 5, formed coaxially on opposite ends thereof with outwardly flaring circumferential flange sections disposed to be engaged by the beads of a tubeless tire. A transverse wall section, disc portion 6, extends transversely of the axis of the circular wheel 2 and its rim 5, and includes a central opening (hub bore area 9) disposed coaxially on said axis. Also illustrated are drop center area 7, valve hole 8, and hub bore area 9. The tire 3 and rim 5 form a tire air chamber 10 that contains a pressured fluid (usually air).

FIG. 2 shows a section of a two-piece wheel assembly 11. The two-piece wheel assembly 11 includes a wheel 12 with tire 3 and inflation valve 4. Parts of wheel 12, as before, include a rim portion 5, a transverse wall or disc portion 6, and a hub bore area 9. Also illustrated, and forming a typical part of a two-piece wheel assembly, is rim flat area 13. The tire 3 and rim 5 form a tire air chamber 10 that, as with the one-piece wheel assembly, contain a pressured fluid (usually air). Two-piece wheels 12 are usually used when a bead lock 14 or run flat device (not shown) are utilized in the two-piece wheel assembly 11. The wall section of two-piece wheels consists of two major parts, an outer portion (or rim half) 15 and inner portion (or rim half) 16. The two portions 15 and 16 are sealed with an o-ring 17 placed between confronting surfaces of the two portions 15 and 16 so as to prevent air from escaping out of tire air chamber 10 (thereby creating a sealed space including tire chamber 10). Studs 18 and nuts 19 bolt the two rim halves 15 and 16 together.

The foregoing drawing figures are exemplary and not limiting in terms of the scope and application of the invention, which can be used and applied without limitation as to wheel type. However, they do serve to illustrate a typical and advantageous area for the use and application of the coatings of the invention, namely the interface 100 between flange sections of rim portions 5 and the beads of tubeless tires 3. This can advantageously be accomplished, given the fact that one the principal intended fields of use for the invention is on the wheels of military vehicles, in accordance with the coating system applicable in the military field. Application of a chemical agent resistant coating (CARC) system on tactical military equipment consists of four distinct steps: cleaning, pretreating, priming, and topcoating. The cleaning and pretreating procedures are standard methods required in any finishing process. The anticorrosive primers are epoxies or Chemical Agent Resistant Cathodic Electrodeposition Primers (MIL-P-53084), and the topcoats are Chemical Agent resistant Aliphatic Polyurethane Coatings (MIL-C-53039). No additional preparation to the vehicle wheel is required beyond priming.

In accordance with the teachings of the invention, it has been determined that there are numerous products that can act as a slip agent that can be added in suspension form (as liquid or powder) to a wheel coating. Generally, any chemically compatible, low static friction coefficient material that is non-adhesion blocking can be used for this purpose. For example, in the MIL-P-53022 liquid coating, cryo-ground polypropylene powder will toughen the surface and add slip as well. Molybdenum disulfide at low concentrations can also be used and has an extremely low coefficient of friction. Likewise, most polyeolefins can be beneficially used in this context to toughen the coating and lower wear rates significantly. However, polytetrafluoroethylene (PTFE) is deemed to be the most advantageous for the purposes of this invention because of its high melting point for powders (co-extruding) and cryo-grind capabilities for wet applications. The wear resistant coating of the invention, typically about 0.001-0.005 inches thick (i.e., 1.0 to 5.0 mils in dry film thickness ("DFT")) is applied by spraying subsequent to the e-coat primer and prior to the CARC topcoat. The system is then cured accordingly.

EXAMPLE

The preferred PTFE coating of the invention was applied to samples of aluminum vehicle wheel material in accordance with the method of the invention. Modified Taber abrasion testing was then performed on the samples in accordance with American Society for Testing and Materials ("ASTM") standard ASTM D4060 for use in testing organic coatings with a Taber Abraser. Taber abrasion testing is done to test a material's resistance to abrasion using a Taber Abrasion Apparatus (or Abraser). Resistance to abrasion is defined as the ability of a material to withstand mechanical action such as rubbing, scraping, or erosion. Abrasion can be difficult to compare, but weight loss is one criterion and is reflected in FIG. 3 along with the number of cycles or rotations until penetration through coating materials to substrate was achieved. Thus, the weight of the various test specimens (i.e., samples) was measured during and after testing. The test specimens were tested using the abrasion tester until the various coatings applied were worn through to the aluminum substrate, after which a final weight was taken.

Figure 3:
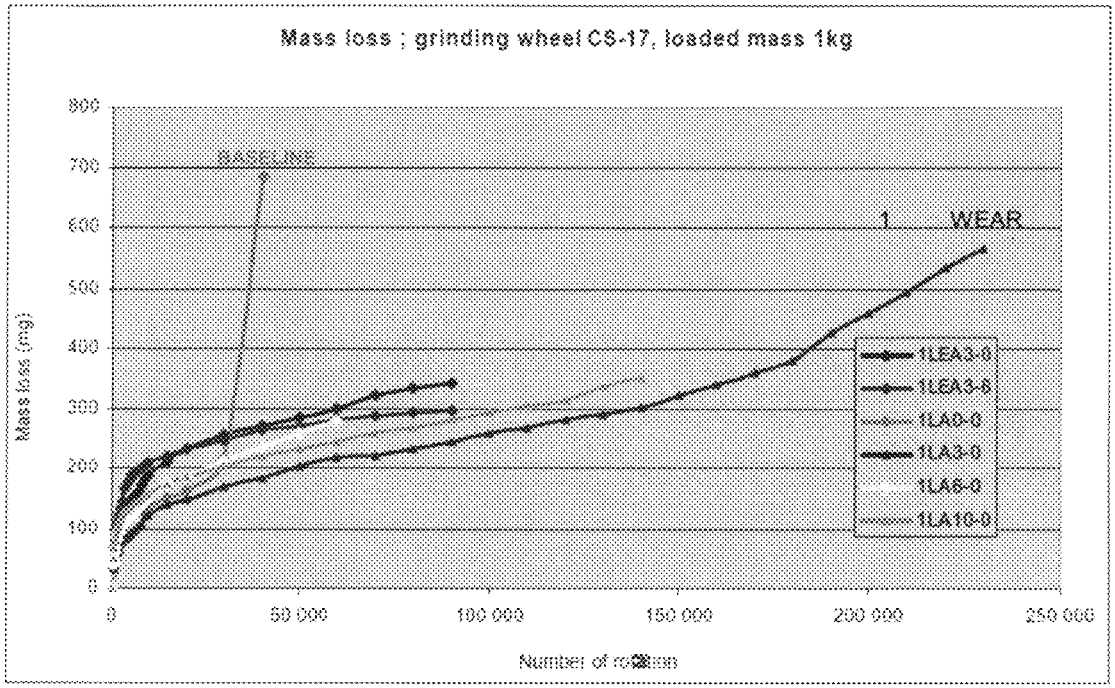
FIG. 3 is a graph illustrating mass loss and cycles or rotations until coating failure of a baseline coating without the invention and of the wear resistant coating taught by this invention.

FIG. 3 provides a graphic representation of the results obtained from the samples used, which covered a wide range of PTFE additions. The results are expressed in by weight loss in mg/# of cycles and number of rotations until penetration to the substrate was achieved. The coated samples were examined for penetration through the coating to the substrate material, i.e., cycles/rotations or cycles/rotations to 'failure'. As reflected in FIG. 3, the wear resistant coating system 20 of the invention, comprised of e-coat primer, epoxy primer with 3% PTFE, and CARC top coat experienced 150% more wear resistance than the baseline system 30 of e-coat primer and CARC topcoat alone. Further, FIG. 3 (though specific to the PTFE slip coating of the preferred embodiment), can be considered to be broadly representative of the results to be obtained generally via the addition of a slip agent in suspension form (as liquid or powder) to a wheel coating, including those to be obtained from some of the other slip agent possibilities specifically named herein.

Limitations with regards to the addition of PTFE is constrained only by methods of suspension prior to and during application and the intercoat adhesion between the primer MIL-P-53084 and the top CARC coating. The wear resistant intermediate coating requires uniform application as well as top coating while still within the curing pot life to maximize intercoat adhesion between the wear resistant coating and the CARC top coating. In cases where such an application method is not possible, the wear resistant coating may still be recoated after full cure and after light mechanical abrasion. In either case the wear resistant properties are not affected.

The wear resistance coating is advantageously formulated in such a manner so as to allow "wet on wet" application over a cured MIL-P-53084 primer. This application method improves adhesion through surface to surface covalent reaction between the polymerization of polyurethane top coat and the polymerization of intermediate epoxy polyamide wear resistant coating. The wear resistant primer may be used by itself over steel wheels that have been pretreated to TT-C-490, and may be used over anodized, electrocoated, or DOD-P-15328 wash primed aluminum as a standalone non-CARC wear resistant coating. The coating may be pigmented to a color other than buff white in non military applications.

The previously described advantages and features of the invention are advantageously provided through and using the preferred embodiment previously illustrated and discussed for the invention's method of coating a vehicle wheel to increase wear resistance, which includes the steps of providing a vehicle wheel and applying a wear resistant coating at least one of containing polytetrafluoroethylene (PTFE), over an initial primer, and under a topcoat. The wear resistant coating is applied to at least the tire bead flange of the vehicle wheel but may be applied to any area of the wheel where CARC top coating will subsequently be applied. The wear resistant coating is of particular use with vehicle wheels made from cast or forged aluminum, but can be used with wheels formed from other materials such as steel or magnesium. The wear resistant coating is, as previously noted, advantageously comprised of a MIL-P-53022B Type II lead and chromate free, corrosion inhibiting epoxy primer with an addition of 3% polytetrafluoroethylene (PTFE).

However, numerous variations may be possible without deviating from and/or exceeding the spirit and scope of the invention, which includes generally the addition of a slip agent that can be added in suspension form (as liquid or powder) to a wheel coating, as well as the particular slip agents named herein. Thus, the invention includes the use of such slip agents intermediate or as part of any coat/layer of a single or multiple coat system. Moreover, various features and functions disclosed above, or alternatives thereof, may be desirably combined into many other different systems or applications. Further, various presently unforeseen or unanticipated alternatives, modifications, variations or improvements therein may be subsequently made by those skilled in the art which are also intended to be encompassed by the claims when filed.

We claim:

1. A vehicle wheel frictional wear alleviation method for non-exposed vehicle wheel rim flange surfaces, comprising:

providing a vehicle wheel with a rim having a flange surface adapted to be placed adjacent to and interface with beads of a tubeless tire when mounted on said wheel rim;

applying a wear resistant coating to said wheel rim flange surface;

mounting a tubeless tire on said rim such that said flange surface is adjacent to and interfaces with the beads of said tubeless tire when mounted on said wheel rim; and wherein said wear resistant coating comprises an intermediate coating including a slip agent comprising a low static friction coefficient material that is non-adhesion blocking to reduce friction between said flange surface and said tire beads, which intermediate coating is applied over an initial primer, and is applied under a topcoat.

2. The method of claim 1, wherein at least one of said initial primer is a chemical agent resistant coating comprising electrodeposition primer, said topcoat is a chemical agent resistant coating comprising aliphatic polyurethane coating, said initial primer is a chemical agent resistant coating comprising a cathodic electrodeposition primer that is cured prior to application of the intermediate coating, and said intermediate coating is applied wet on wet to said initial primer.

3. The method of claim 2, wherein at least one of: said initial primer is a MIL-P-53084 cathodic electrodeposition primer, and said topcoat is a MIL-C-53039 chemical agent resistant aliphatic polyurethane coating.

4. The method of claim 1, wherein said slip agent comprises polytetrafluoroethylene.

5. The method of claim 2, wherein said slip agent comprises polytetrafluoroethylene.

6. The method of claim 3, wherein said slip agent comprises polytetrafluoroethylene.

7. The method of claim 1, wherein said intermediate coating at least one of: includes an epoxy primer, is lead free, is chromate free, is corrosion inhibiting, and has a dry film thickness between approximately 1.0 and 5 mils.

8. The method of claim 2, wherein said intermediate coating at least one of: includes an epoxy primer, is lead free, is chromate free, is corrosion inhibiting, and has a dry film thickness between approximately 1.0 and 5 mils.

9. The method of claim 3, wherein any said intermediate coating at least one of: includes an epoxy primer, is lead free, is chromate free, is corrosion inhibiting, and has a dry film thickness between approximately 1.0 and 5 mils.

10. The method of claim 4, wherein said intermediate coating at least one of: includes an epoxy primer, is lead free, is chromate free, is corrosion inhibiting, and has a dry film thickness between approximately 1.0 and 5 mils.

11. The method of claim 5, wherein said intermediate coating at least one of includes an epoxy primer, is lead free, is chromate free, is corrosion inhibiting, and has a dry film thickness between approximately 1.0 and 5 mils.

12. The method of claim 6, wherein said intermediate coating at least one of: includes an epoxy primer, is lead free, is chromate free, is corrosion inhibiting, and has a dry film thickness between approximately 1.0 and 5 mils.

13. The method of claim 4, wherein any said polytetrafluoroethylene comprises approximately 3% of said wear resistant coating.

14. The method of claim 5, wherein any said polytetrafluoroethylene comprises approximately 3% of said wear resistant coating.

15. The method of claim 6, wherein any said polytetrafluoroethylene comprises approximately 3% of said wear resistant coating.

16. The method of claim 10, wherein any said polytetrafluoroethylene comprises approximately 3% of said wear resistant coating.

17. The method of claim 11, wherein any said polytetrafluoroethylene comprises approximately 3% of said wear resistant coating.

18. The method of claim 12, wherein any said polytetrafluoroethylene comprises approximately 3% of said wear resistant coating.

19. The method, of claim 1, wherein said slip agent comprises at least one of polypropylene, molybdenum disulfide, and a polyeolefin.

20. The method of claim 8, wherein said slip agent comprises at least one of polypropylene, molybdenum disulfide, and a polyeolefin.

* * * * *